US008584317B2

(12) United States Patent
Liebscher et al.

(10) Patent No.: US 8,584,317 B2
(45) Date of Patent: Nov. 19, 2013

(54) CEILING TRACK SYSTEM FOR GUIDING WALL ELEMENTS

(75) Inventors: Arne Liebscher, Herdecke (DE); Olaf Lüttmann, Zwischenahn (DE)

(73) Assignee: Dorma GmbH + Co. KG, Ennepetal (DE)

( * ) Notice: Subject to any disclaimer, the term of this patent is extended or adjusted under 35 U.S.C. 154(b) by 0 days.

(21) Appl. No.: 13/383,178

(22) PCT Filed: Jul. 7, 2010

(86) PCT No.: PCT/EP2010/004084

§ 371 (c)(1), (2), (4) Date: Jan. 9, 2012

(87) PCT Pub. No.: WO2011/003578

PCT Pub. Date: Jan. 13, 2011

(65) Prior Publication Data

US 2012/0117756 A1 May 17, 2012

(30) Foreign Application Priority Data

Jul. 10, 2009 (DE) ..... 20 2009 009 548 U

(51) Int. Cl.
*E05D 15/00* (2006.01)
*E05D 15/06* (2006.01)
*E05D 13/00* (2006.01)

(52) U.S. Cl.
USPC ..... 16/91; 16/94 R; 16/96 R; 160/196.1; 52/243.1; 49/425; 49/360

(58) Field of Classification Search
USPC ..... 16/94 R, 96 R, 91, 106; 160/196.1; 52/243.1; 49/425, 410, 360
See application file for complete search history.

(56) References Cited

U.S. PATENT DOCUMENTS

| | | | | | |
|---|---|---|---|---|---|
| 2,945,535 | A | * | 7/1960 | Haws | 160/40 |
| 3,072,975 | A | * | 1/1963 | Burmeister | 49/317 |
| 3,073,381 | A | * | 1/1963 | Burmeister | 160/40 |
| 3,672,424 | A | * | 6/1972 | Brown | 160/40 |
| 3,854,165 | A | * | 12/1974 | Haley | 16/96 R |
| 4,694,531 | A | * | 9/1987 | Foy | 16/87.4 R |
| 4,752,987 | A | * | 6/1988 | Dreyer et al. | 16/102 |
| 5,193,319 | A | * | 3/1993 | Claassen et al. | 52/243.1 |

(Continued)

FOREIGN PATENT DOCUMENTS

| | | | |
|---|---|---|---|
| DE | 3147273 | A * | 7/1983 |
| DE | 19620045 | C1 * | 10/1997 |

(Continued)

*Primary Examiner* — Victor Batson
*Assistant Examiner* — Jason W San
(74) *Attorney, Agent, or Firm* — Cozen O'Connor

(57) ABSTRACT

A ceiling track system including a guiding rail, in which at least one wall element is received and an encasing element that is affixed to the guiding rail. A long leg extends in a vertical joining direction and has a latching geometry, into which a latching hook can be latched such that the encasing element is affixed to the guiding rail in a self-retaining manner. The long leg has a web with a projection. The guiding rail has a groove into which the projection engages for the purpose of self-retaining the encasing element. Adjacent to the groove the guiding rail has a screw reception into which a screw element is screwable by which a clamping action is achieved. The screw reception is at an angle with regard to the vertical joining direction.

13 Claims, 3 Drawing Sheets

(56) References Cited

U.S. PATENT DOCUMENTS

| | | | | |
|---|---|---|---|---|
| 5,335,890 | A * | 8/1994 | Pryor et al. | 248/343 |
| 5,450,693 | A * | 9/1995 | Tarrega | 49/411 |
| 5,542,149 | A * | 8/1996 | Yu | 16/87.4 R |
| 5,544,462 | A * | 8/1996 | Kordes | 52/243.1 |
| 5,603,192 | A * | 2/1997 | Dickson | 52/238.1 |
| 6,082,053 | A * | 7/2000 | Bischof et al. | 52/64 |
| 6,098,342 | A * | 8/2000 | Bischof et al. | 49/409 |
| 6,233,878 | B1 * | 5/2001 | Krahenbuhl et al. | 52/64 |
| 6,321,822 | B1 * | 11/2001 | Horner et al. | 160/194 |
| 6,336,247 | B1 * | 1/2002 | Schnoor | 16/87.6 R |
| 6,357,079 | B1 * | 3/2002 | Hsu | 16/87 R |
| 6,516,566 | B2 * | 2/2003 | Finke | 49/127 |
| 6,517,244 | B2 * | 2/2003 | Ishihara | 384/13 |
| 6,634,149 | B2 * | 10/2003 | Cates et al. | 52/283 |
| 6,813,862 | B2 * | 11/2004 | Perich et al. | 49/425 |
| 7,357,428 | B2 * | 4/2008 | Kletscher | 292/139 |
| 7,520,093 | B2 * | 4/2009 | Guhl | 52/204.1 |
| 7,653,966 | B2 * | 2/2010 | Quinn et al. | 16/96 R |
| 7,703,242 | B2 * | 4/2010 | Goebel et al. | 49/425 |
| 7,712,258 | B2 * | 5/2010 | Ewing et al. | 49/410 |
| 7,743,557 | B2 * | 6/2010 | Liao | 49/409 |
| 7,779,578 | B2 * | 8/2010 | Gray | 49/506 |
| 7,861,474 | B2 * | 1/2011 | Houle et al. | 52/242 |
| 7,891,052 | B2 * | 2/2011 | Haab et al. | 16/98 |
| 8,033,068 | B2 * | 10/2011 | Luttmann et al. | 52/243.1 |
| 8,099,904 | B2 * | 1/2012 | Saccon | 49/246 |
| 8,117,784 | B2 * | 2/2012 | Tarrega Illoret | 49/425 |
| D662,403 | S * | 6/2012 | Page | D8/377 |
| 8,402,699 | B2 * | 3/2013 | Henriott | 52/36.1 |
| 2001/0037605 | A1 * | 11/2001 | Finke | 49/360 |
| 2006/0101745 | A1 * | 5/2006 | Kleege | 52/243.1 |
| 2008/0115329 | A1 * | 5/2008 | Liao | 16/96 R |
| 2009/0044468 | A1 * | 2/2009 | Scapin | 52/239 |
| 2009/0100760 | A1 * | 4/2009 | Ewing | 49/410 |
| 2010/0088963 | A1 * | 4/2010 | Cevenini | 49/360 |
| 2010/0095596 | A1 * | 4/2010 | Luca | 49/360 |
| 2010/0175327 | A1 * | 7/2010 | Busch et al. | 49/360 |
| 2012/0117756 | A1 * | 5/2012 | Liebscher et al. | 16/91 |

FOREIGN PATENT DOCUMENTS

| | | | |
|---|---|---|---|
| DE | 102009011947 | A1 * | 9/2010 |
| EP | 959219 | A2 * | 11/1999 |
| JP | 2000352259 | A * | 12/2000 |
| WO | WO 9742388 | A1 * | 11/1997 |
| WO | WO 2009152943 | A1 * | 12/2009 |
| WO | WO 2010102730 | A1 * | 9/2010 |
| WO | WO 2010108585 | A1 * | 9/2010 |

* cited by examiner

CEILING TRACK SYSTEM FOR GUIDING WALL ELEMENTS

CROSS REFERENCE TO RELATED APPLICATIONS

This is a U.S. national stage of application No. PCT/EP2010/004084, filed on 7 Jul. 2010. Priority is claimed on German Application No. 20 2009 009 548.7 filed 10 Jul. 2009, the content of which is incorporated here by reference.

BACKGROUND OF THE INVENTION

Field of the Invention

The present invention is directed to a ceiling track system including a guiding rail, in which at least one wall element is received via a carriage unit, wherein at least one encasing element is affixed to the guiding rail.

Ceiling track systems including a guiding rail are utilized to maintain and to displace wall elements in the guiding rail, which are received therein via carriage units. In addition to manually displaceable wall elements, carriage units with drive units driven by a motor, are known, to displace the carriage units and as a consequence the wall elements in the guiding rail. The guiding rails of such ceiling track systems are mounted to the ceiling of a room, wherein the wall elements can be displaced between a parking position and a position in which they form a partition wall. The rooms in which such partition wall systems are utilized are very often conference rooms, self-service restaurants, reception areas in business premises, or customer service areas in banks.

Laterally disposed encasing elements, which laterally cover the travel space of the carriage units between the guiding rail and the wall elements, can be affixed to the guiding rails. The encasing elements are manually fastened to the guiding rail wherein a mechanic installer has to perform the fastening while working overhead. Fastners are known that consist of sliding blocks, received in the guiding rail, and screw elements screwable into said sliding blocks. Therefore mounting the encasing elements, which have a conventional length of up to three meters and more, is very complicated. Following the first installation, very often the encasing elements need to be temporarily removed to perform maintenance work on the carriage units, which are received in the guiding rail.

Furthermore, manipulating and mounting the encasing elements is difficult, because very often the ceiling track systems need to be mounted adjacent to walls or at suspended ceilings, wherein the connecting plane between the carriage unit and the wall element is located on a level with the suspended ceiling. As a consequence, the encasing elements need to be connected to the guiding rail in the space above the suspended ceiling or adjacent to the room wall. Conventionally known connectors, such as sliding blocks and associated screw elements cannot be utilized for such a ceiling arrangement.

SUMMARY OF THE INVENTION

Therefore, it is an object of the present invention to further develop a ceiling track system including a guiding rail and at least one encasing element to be affixed to the latter, such that mounting the encasing element to the guiding rail is simplified.

The invention includes a guiding rail that has a latching geometry, into which a latching hook, disposed at the encasing element, is latchable in such a way that, from a unidirectional joining direction, the encasing element can be affixed in a self-retaining way to the guiding rail.

One embodiment of the invention utilizes a latching of the encasing element to the guiding rail to simplify the installation of the encasing element in an overhead position for the mechanic installer. The installer just needs to latch the encasing element into the guiding rail. The joining direction is configured to be unidirectional, i.e. the joining can only be done from a single direction and the encasing element just needs to be moved in one plane towards the guiding rail. In this case, the latching hook disposed at the encasing element will latch with a latching geometry of the guiding rail. Both the latching hook and the latching geometry, individually or together, may be configured continuously across the entire length of the guiding rail respectively, wherein likewise a certain amount of individual latching hooks with associated latching geometries may be provided at the guiding rail.

The guiding rail is affixed to the ceiling of a room and the unidirectional joining direction extends vertically underneath the guiding rail in such a way that the encasing element can be joined from underneath in a direction towards the guiding rail. The mechanic installer can move the encasing element in vertical direction upwards towards the guiding rail in such a way that, on account of the inventive latching arrangement of the latching hook and the latching geometry, the encasing element can be hooked to the guiding rail in a self-retaining manner. As a consequence, a one-man mounting of an encasing element to the guiding rail is possible, because a first mechanic installer does no longer have to hold the guiding rail while a second mechanic installer performs the screw connection of the encasing element to the guiding rail.

The encasing element is configured in the shape of an L-profile with a long and a short leg, wherein the long leg extends in the vertical joining direction. The shape of the encasing element is defined by the area to be covered, which is determined by the travel space of the carriage unit in the longitudinal direction of the guiding rail. The long leg of the encasing element forms the vertical exterior surface of the encasing, wherein, in the installed condition, the short leg of the encasing element forms a cladding, in order to minimize as much as possible the slot which can be seen at the ceiling of the room. The width of the slot is defined by the connecting geometry of the wall element to the carriage unit configured in the shape of a carrying bolt. The diameter of said bolt is smaller than the width of the guiding rail such that the difference width is covered by the short legs of the encasing elements which are affixed on both sides.

For latching the encasing element to the guiding rail, the latching hook is disposed at the end of the long and vertically extending leg of the encasing element and extends in the prolongation of the leg axis. On the outside, the latching hook may merge homogeneously with the long leg of the encasing element such that no visual interruption between the area of the latching hook and the area of the long and vertically extending leg of the encasing element is created.

In this case, the encasing element, neighbouring the area of the cross-sectional constriction, has a web with a projection, wherein the guiding rail has a groove into which the projection engages to keep the encasing element at the guiding rail in a self-retaining manner. The projection comes to abut against a flank of the groove and constitutes the counter-retaining part to the latching of the latching hook in the latching geometry provided in the guiding rail. It is only by the cooperating effect of the form closure, which is generated by the projecting web at the flank of the groove, with the latching of the latching hook in the latching geometry, that the encasing element can be affixed to the guiding rail in a self-retaining manner, and a certain releasing force needs to be applied to release the encasing element from the guiding rail in the opposite direction to the joining direction. The rigidity of the latching hook is dimensioned such that the releasing force is larger than the weight of the encasing element. In this case, the recovery. of the latching hook forms the only resiliency within the connecting system such that the self-retaining force of the encasing element at the guiding rail is thereby determined.

Adjacent to the groove, the guiding rail has a screw reception in which a screw element is screwable, wherein, by screwing the screw element in, a clamping action of the web at the guiding rail is created. The self-retaining latching of the encasing element at the guiding rail just serves during the pre-installation and the final attachment of the encasing element at the guiding rail is realized by a screw connection. If the screw element is screwed into the screw reception, the web is clamped against the guiding rail, because the web extends at least partially under the screw head of the screw element. The web may be configured in a length that extends beyond the screw reception and the screw element may be led through a hole in the web, wherein the screwing of the encasing element to the guiding rail is realized via the web. Furthermore, the screw element can be affixed to the web of the encasing element in a captive arrangement such that, by simply latching the encasing element to the guiding rail, the screw element is already positioned in the screw reception for the screwing action.

The screw reception is oriented at an angle with respect to a vertical joining direction to screw the screw element from the direction of the symmetry plane of the guiding rail. On the left and right sides of the travel path of the carriage unit, the guiding rail is configured to be symmetrical such that one plane of symmetry is located on half the width of the guiding rail. The L-shaped encasing element is affixed to the guiding rail such that the short leg of the L-shape points into the direction of the plane of symmetry. As the screw reception is located on the inside, with the encasing element being in place, a slanted screw reception allows for utilizing a tool, such that screwing the screw element into the screw reception from the outside is possible, in that the tool is passed manually through the gap that extends between the opposing encasing elements affixed to the guiding rail. It is thereby possible to proceed to screwing the encasing elements to the guiding rail from the underside of the ceiling, such as screwing, while utilizing a tool, is possible even if the guiding rail and the encasing elements are located behind the intermediate ceiling or neighbouring a room wall, because lateral accessibility to the encasing elements, for the purpose of screwing them to the guiding rail, is not required.

Another embodiment of the ceiling track system has a latching hook with a nose conformation, which, in the joined position of the encasing element, engages into an undercut, which constitutes the latching geometry and is provided on the outside of the guiding rail. The latching action of the nose conformation and the latching geometry is realized in that, at any time, the nose conformation can be removed from the latching geometry. The latching hook is resiliently led in the direction towards the outside of the encasing element, if the latter is moved along the guiding rail. As the nose conformation latches with the latching geometry, the latching hook snaps back from the resilient position and a. form closure is created between the nose conformation of the latching hook and the latching geometry at the guiding rail. For an improved resiliency of the latching hook at the encasing element, the transition area from the encasing element to the latching hook has a cross-sectional constriction. The rigidity of the connection between the latching hook and the encasing element is thereby reduced, such that the latching hook is able to yield resiliently already under a low action of force, and the nose conformation can move across the latching geometry at the guiding rail.

Another advantageous embodiment of the guiding rail has butt-joint arrangements, in order to interconnect several guiding rails in the traveling direction of the carriage unit. A ceiling track system consists of a plurality of guiding rails, wherein straight elements and curved elements are interconnected. The connection is realized via butt joint arrangements introduced into a reception geometry at the end side of the guiding rail. The butt connectors comprise metal webs which, at their first side, can be screwed to a first guiding rail and, at their second side, to a second guiding rail. The screw connection of the butt joint arrangements is realized from the joining direction, from which the encasing elements can be affixed to the guiding rails.

The cross-section of the guiding rail is configured to be box-shaped wherein the guiding rails are preferably formed from an aluminum extruded profile. Essentially the box-shaped profile of the guiding rail has a rectangular form, wherein topside fastening conformations are provided for affixing the guiding rail to the ceiling of the room. The latching geometries, described in the introduction, are provided laterally on both the left outside and the right outside of the guiding rail. On the underside, the guiding rail has two areas pointing to the direction of the plane of symmetry, wherein the groove, the screw reception and the butt joint arrangement are provided in the lower outside of the guiding rail. The mentioned geometries may extend over the entire length of the guiding rail wherein the screw reception is either provided as bores at regular intervals or extends as a longitudinal groove along the guiding rail and the screw element is a self-cutting screw, which, when being screwed in, forms a thread in the flanks of the groove-shaped screw reception.

In one embodiment, the screw reception is configured as a longitudinally extending screw channel or as a longitudinal groove with a thread such that a metrical screw can be repeatedly screwed in at any given position.

It is advantageous if the guiding rail presents guiding surfaces that are inwards oriented and cooperate with a guiding device disposed at the carriage unit for guiding the carriage unit. In this case, the guiding rail does not present a closed box-shaped profile; but the areas, in which at least the groove, the screw reception and the butt-joint arrangement are disposed at the underside, extend to the left side and the right side in the direction of the symmetry axis, and terminate in opposite guiding surfaces, which cooperate with a guiding device for the purpose of guiding the carriage unit. The carriage unit is subdivided into a roller carriage, rolling in the guiding rail and being disposed above the guiding device, and a drive unit disposed below the guiding rail, wherein the encasing elements form the lateral covering of the drive unit. The roller carriage on the contrary is received within the hollow space of the guiding rail. As a consequence, the connection between the roller carriage and the drive unit is configured by the guiding device, which, for example, may comprise a guiding roller. This guiding roller rolls along the inwards oriented guiding surfaces such that guidance within the guiding rail is provided for the carriage unit.

According to one embodiment of the invention, the roller carriage has at least two rollers that roll on rolling surfaces configured in the direction of the symmetry axis of the guiding rail. The rolling surfaces are configured on the areas of the guiding rail, in which, on the underside, at least the screw reception, the groove and the butt-joint arrangement are fitted. The roller carriage may have two or four rollers, wherein the rollers may consist of plastic material, in order to roll on the rolling surfaces of the guiding rail which consists of aluminum. Furthermore, the rollers may be manufactured from a metal, wherein the rolling surfaces of the guiding rail are configured to receive rolling inserts, in order to provide for a minimum wear rolling contact between the rollers and the rolling inserts. The rolling inserts may consist for example of spring steel, in order to avoid contact between the aluminum material of the guiding rail and the rollers consisting of metal.

To feed and/or to control a drive motor, which is received in the drive unit and serves to displace the wall element in the guiding rail, the roller carriage has at least one current collector, which cooperates with at least one associated power rail in a power transmitting and/or signal transmitting manner. Three power rails may be mounted in the guiding rail and are received inside the guiding rail by insulators. Current collectors, which, according to the principle of a pantograph of an electric train, pick off the current from the current rails, and are located at the roller carriage. In case three current collectors are provided, one of the three current collectors represents the ground such that a second current collector with respect to ground allows for power supply and the third current collector with respect to ground allows for signal transmission.

According to one embodiment of the invention, a ceiling track system including a guiding rail is provided, which can be simply manufactured in a continuous casting process, and fulfils all functions for operating self-propelled carriage units for displacing wall elements. The guiding rail offers the possibility to latch encasing elements thereto, and, if required, to screw the encasing elements with a tool to the guiding rail via an access on the underside. As a result, a ceiling track system is created, which allows for a considerably simplified mounting of the encasing elements and nevertheless, by the specially configured guiding rails, fulfills all functions of an automatically operating ceiling track system for displacing wall elements.

BRIEF DESCRIPTION OF THE DRAWINGS

Hereinafter, further measures enhancing the invention will be illustrated in more detail in conjunction with the description of preferred embodiments of the invention based on the Figures, in which.

DETAILED DESCRIPTION OF THE PREFERRED EMBODIMENTS

Figures 1A, 1B, 1C:
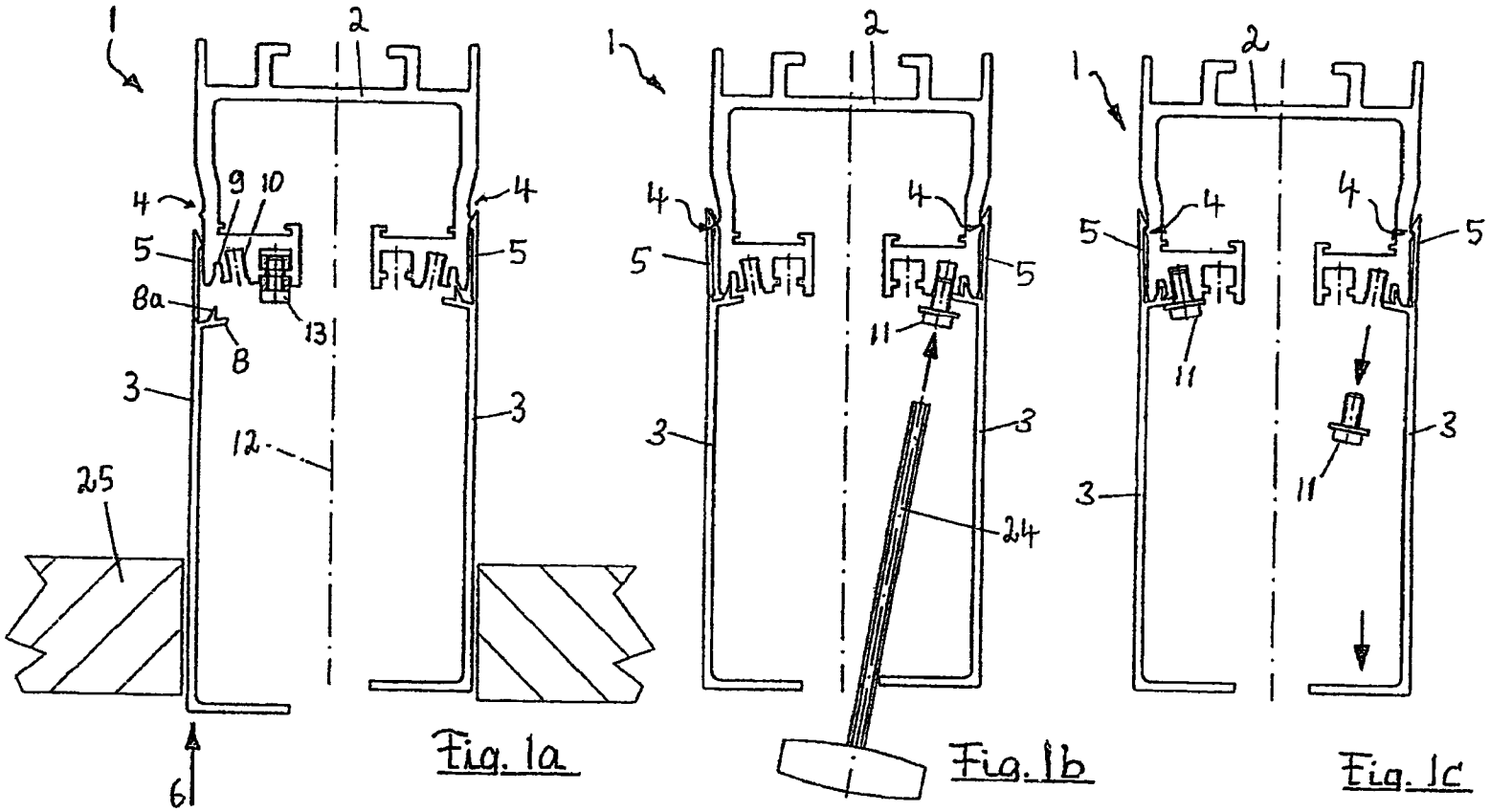
FIGS. 1*a* to 1*c*: are cross-sectional views of a ceiling track system including a guiding rail and encasing elements mounted to said rail in different mounting stages.

FIG. 1*a* shows a ceiling track system 1 including a guiding rail 2, to which respectively one encasing element 3 is mounted on the underside on both the left longitudinal side and the right longitudinal side. In order to provide for preliminarily latching the encasing elements 3 to the guiding rail 2 prior to subsequently screwing the encasing elements 3 to the guiding rail 2, the guiding rail, on both the left exterior longitudinal surface and the right exterior longitudinal surface, has a respective latching geometry 4, into which a respective latching hook 5, disposed at the encasing element 3, is latchable in such a way that the encasing element 3 can be fitted to the guiding rail 2 in a self-retaining manner from a unidirectional joining direction 6. The joining direction 6 is suggested by an arrow, wherein on the right side the encasing element 3 to be latched is already pushed in the joining direction 6 so far that the latching hook 5 is disposed just prior to latch with the latching geometry 4. The left encasing element 3 is still on the joining path such as to be illustrated offset below the encasing element 3 shown on the right side.

As shown in FIGS. 1*a*-1*c*, the encasing elements 3 have webs 8, which point into the direction of the plane of symmetry 12 of the guiding rail 2. Projections 8*a*, which can engage in an associated groove 9 within the guiding rail 2, are fitted to the webs 8. According to FIG. 1*c*, the screw elements 11 are screwed into the screw receptions 10 with a tool 24, the screw elements 11 clamp the webs 8 to the guiding rail 2.

To connect several guiding rails 2 to each other, butt-joint arrangements 13 are provided. They consist of web elements that extend across the butt-joint connection of the guiding rail 2 and are screwed within each of the guiding rail 2. As a consequence, a transition between two guiding rails 2 is assured, without an offset being present between the two guiding rails 2.

FIG. 1*b* is a ceiling track system 1 with a guiding rail 2 and one encasing element 3 on the left side and one on the right side, wherein the encasing element 3 on the right side is already latched with the guiding rail 2. On the other hand, the encasing element 3 shown on the left side is positioned prior to latching such that a resilient yielding of the latching hook 5 is shown to move the element over the latching geometry 4 at the guiding rail 2. Once the latching action has taken place, the encasing elements 3 may be screwed by a screw element 11 and an associated tool 24, wherein the tool 24 can be introduced from the underside of the guiding rail 2. In case the encasing elements 3 are located behind an intermediate ceiling 25, as suggested in FIG. 1*a*, the screw elements 11 can nevertheless be inserted into the associated screw receptions 10.

FIG. 1*c* shows the ceiling track system 1 including the guiding rail 2 and the associated encasing elements 3 in the condition in which the encasing elements 3 are already firmly latched with the guiding rail 2. It can be seen that both, on the left side and on the right side, respective latching hooks 5 are latched with undercuts in the exterior surface of the guiding rail 2, which undercuts are formed by the latching geometry 4.

Figure 2B:
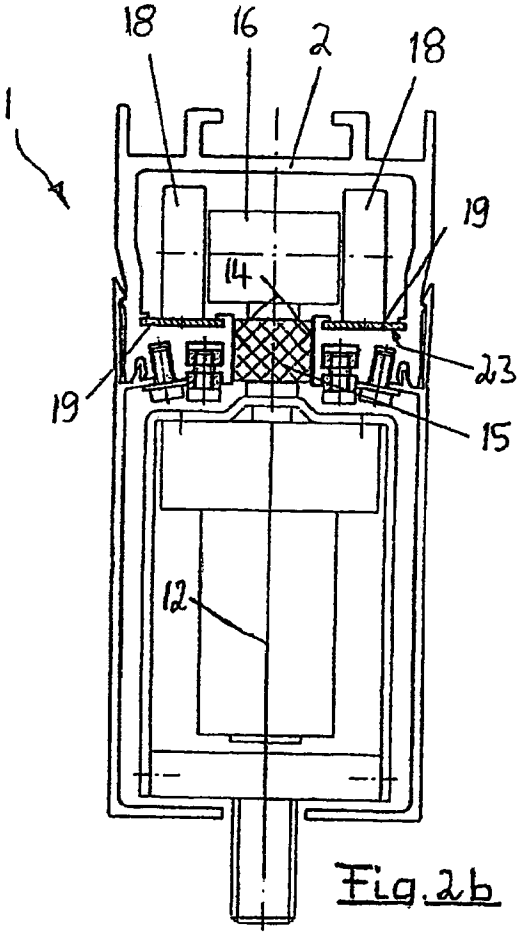
FIGS. 2*a* to 2*b*: are cross-sectional views of the ceiling track system and a carriage unit, which consists of at least one roller carriage, a guiding device and a drive unit, wherein different types of rollers and rolling surfaces are illustrated.
Figure 2A:
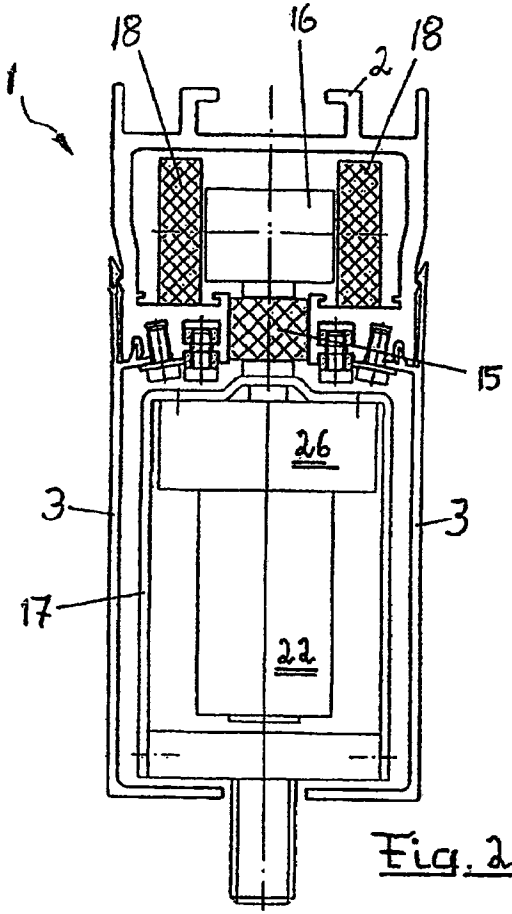

The FIGS. 2*a* and 2*b* show the ceiling track system 1 including the guiding rail 2 and two respectively disposed encasing elements 3 in a cross-sectional view. A carriage unit, which consists of a roller carriage 16 and a drive unit 17, is shown in cross-section. A guiding device 15, having the function of guiding the carriage unit within the guiding rail 2, is shown between the roller carriage 16 and the drive unit 17. The guiding device 15 consists of a plastic material roller, which is guided on the left and right sides in the guiding rail 2.

A first embodiment of the rollers 18 supported in the roller carriage 16, is shown in FIG. 2*a*. In this case, at least one of the two rollers 18 may be driven by the drive motor 22, which is a component of the drive unit 17. Via a transmission 26, the drive motor 22 drives the at least one roller 18, which rolls on an inner surface in the guiding rail 2. If the rollers 18 are manufactured from plastic material, the possibility is given to establish a rolling contact directly between the rollers 18 and the surface of the rolling surface in the guiding rail 2.

The embodiment according to FIG. 2*b* has a ceiling track system 1 including rollers 18, which are manufactured from metallic material. In order to establish a rolling contact between the metallic rollers 18 and the guiding rail 2, which is manufactured from aluminum, the rolling surfaces 23 of the guiding rail 2 are configured to receive rolling inserts 19. The inserts may consist of steel, in order to offer a rolling contact at minimum wear. The guiding device is represented by a guiding roller that comprises plastic material. The latter rolls on the guiding surfaces 14, which are configured on the inside of the guiding rail 2.

Figure 3:
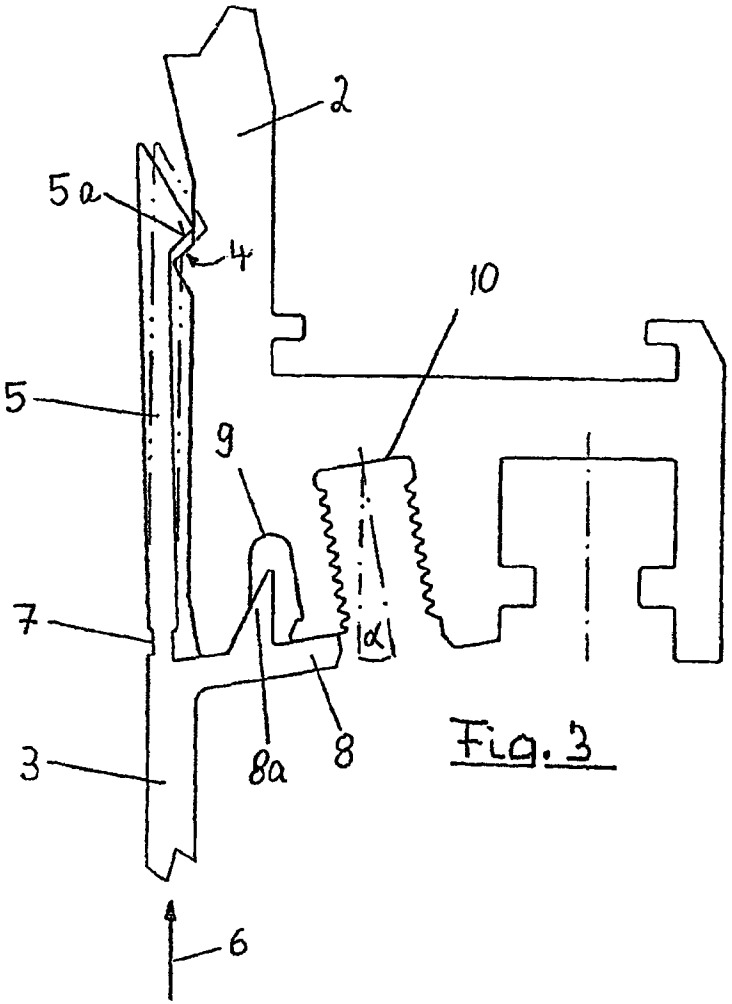
FIG. 3: is a detailed view of the latching connection of an encasing element at the guiding rail.

In a detailed view FIG. 3 shows the latching arrangement of an encasing element 3 at the guiding rail 2. The joining direction for latching the encasing element 3 is illustrated by the arrow 6. The transition from the encasing element 3 to the latching hook 5 includes a cross-sectional constriction 7, to allow for an improved yielding resiliency of the latching hook 5, when the nose conformation 5*a* at the end of the latching hook 5 is moved over the latching geometry 4 in the guiding rail 2. The latching hook 5 is shown in a partially resiliently yielding position in which the non-deformed position of the latching hook 5 is shown by a dash-dotted contour.

To form a counter-holder for the latching system at the latching geometry 4, a web 8, which has a projection 8*a*, is conformed to the encasing element 3. In the joined position, the projection 8*a* extends into a groove 9, which is fitted into the guiding rail 2. Neighbouring the groove 9, the guiding rail 2 has a screw reception 10, which is fitted at an angle a with regard to the joining direction 6. The screw element can be screwed into the screw reception 10 and the terminal side of the web 8 is clamped at the guiding rail 2. The screw reception may be configured as a longitudinally extending screw channel or as a longitudinal groove with threads such that a metrical screw can be repeatedly screwed in at any given position.

Figure 4:
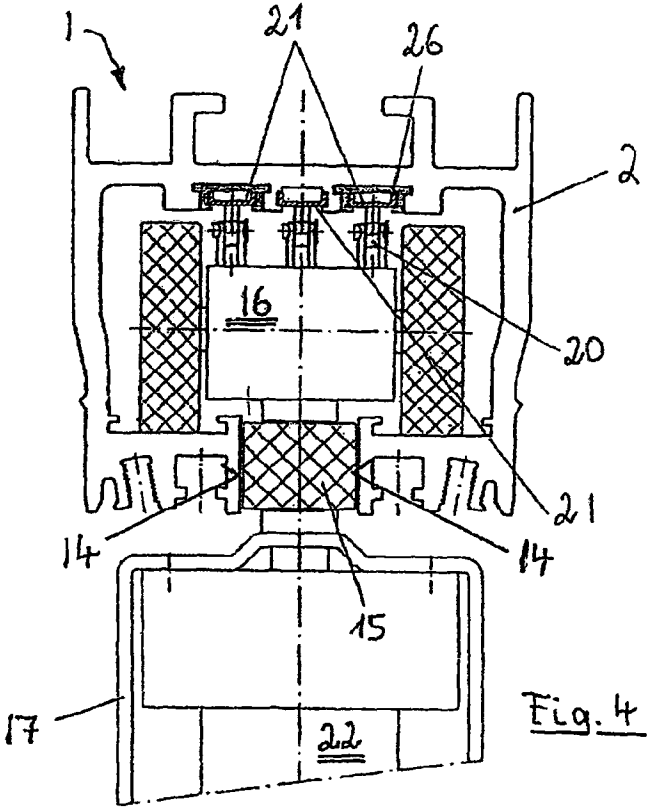
FIG. 4: is a carriage unit guided in the guiding rail and has a current collector to feed a drive motor received in the drive unit.

FIG. 4 shows another cross-section through the ceiling track system 1 including a carriage unit, which, with regard to its essential structural components, consists of the guiding device 15, the top side roller carriage 16 and the bottom side drive unit 17. Guiding the guiding device 15 is realized on both the left side and the right side via a respective guiding surface 14 fitted to the guiding rail 2. Furthermore, the ceiling track system 1 has current collectors 20 to allow the power rails 21 provided in the guiding rail 2 to convey supply current to the drive motor 22 and/or to transmit signals. As a consequence, the carriage unit can be displaced in the guiding rail 2, and current, respectively a signal is transmittable to the carriage unit independently from the displacement position. The power rails 21 are received in the guiding rail 2 via insulators 26.

The invention in its configuration is not limited to the above presented preferred embodiment. On the contrary, a wide number of variants is conceivable, which make use of the described solution likewise with basically different types of configurations. In particular the latching geometry 4 may be configured to be continuous in displacement direction along the guiding rail 2, or the latching geometry 4 is located at regular intervals at the outside of the guiding rail 2. In the same way, the encasing elements 3 may have a continuous latching hook 5, or the latter is adapted to the respective distances of the latching geometry 4 at the guiding rail 2 such that a plurality of latching hooks 5 is conformed to the encasing element 3.

Thus, while there have shown and described and pointed out fundamental novel features of the invention as applied to a preferred embodiment thereof, it will be understood that various omissions and substitutions and changes in the form and details of the devices illustrated, and in their operation, may be made by those skilled in the art without departing from the spirit of the invention. For example, it is expressly intended that all combinations of those elements and/or method steps which perform substantially the same function in substantially the same way to achieve the same results are within the scope of the invention. Moreover, it should be recognized that structures and/or elements and/or method steps shown and/or described in connection with any disclosed form or embodiment of the invention may be incorporated in any other disclosed or described or suggested form or embodiment as a general matter of design choice. It is the intention, therefore, to be limited only as indicated by the scope of the claims appended hereto.

The invention claimed is:

1. A ceiling track system comprising:

a guiding rail having a latching geometry;

at least one wall element is received in the guiding rail via a carriage unit;

at least one encasing element, configured as a profile in an L-shape having one long and one short leg, is affixed to the guiding rail, wherein the long leg extends in a vertical joining direction;

a latching hook disposed at the long leg configured to be latched to the latching geometry to affix the encasing element to the guiding rail from a unidirectional joining direction in a self-retaining manner;

a geometric transition, between the long leg of the encasing element and the latching hook, has a cross-sectional constriction;

a web with a projection arranged at the long leg adjacent to the area of the cross-sectional constriction;

a groove in the guiding rail, into which the projection engages for the self-retaining purpose of the encasing element at the guiding rail;

a screw reception in the guiding rail adjacent to the groove; and a screw element is screwable into the screw reception, wherein a clamping action of the web at the guiding rail is achieved;

wherein the screw reception is configured at an angle with regard to the vertical joining direction, to screw in the screw element from the direction of a plane of symmetry of the guiding rail.

2. The ceiling track system according to claim 1 wherein the guiding rail is affixed to a ceiling of a room and the unidirectional joining direction extends in vertical direction on the underside of the guiding rail.

3. The ceiling track system according to claim 1, wherein the latching hook is disposed at an end of the long and vertically extending leg of the encasing element and extends in prolongation of the leg axis.

4. The ceiling track system according to claim 1, wherein the latching hook has a nose formation, which, in a joining direction of the encasing element, latches with an undercut in an outside of the guiding rail, which undercut constitutes the latching geometry.

5. The ceiling track system according to claim 1, wherein two encasing elements are disposed at the guiding rail in opposing arrangement and are disposed above lateral areas of the travel space of the carriage unit.

6. The ceiling track system according to claim 1, wherein the guiding rail has a respectively butt-joint arrangement on both sides neighboring the screw reception to interconnect a plurality of guiding rails in joining direction.

7. The ceiling track system according to claim 1, wherein the guiding rail has inward-oriented guiding surfaces which cooperate with a guiding device disposed at the carriage unit to guide the carriage unit.

8. The ceiling track system according to claim 7, wherein the carriage unit has roller carriage disposed at the top side of the guiding device and running in the guiding rail, and has a drive unit disposed vertically underneath the guiding rail, wherein the encasing elements form a lateral covering of the drive unit.

9. The ceiling track system according to claim 8, wherein the roller carriage has at least two rollers, which roll on roller surfaces and are configured in the direction of the plane of symmetry of the guiding rail, which surfaces are formed by areas of the guiding rail in which respectively at least the screw reception and the butt-joint arrangement are fitted.

10. The ceiling track system according to claim 9, wherein the rolling surfaces of the guiding rail receive roller inserts for the rollers to roll on.

11. The ceiling track system according to claim 8, wherein the roller carriage has at least one current collector that cooperates with at least one associated power rail in at least one of a power transmitting and signal transmitting manner, to at least one of feed and control a drive motor received in the drive unit and displaces the wall element in the guiding rail.

12. The ceiling track system according to claim 1, wherein the screw reception is one of a longitudinally extending screw channel and a longitudinal groove with threads such that a screw can be repeatedly screwed in at any given position.

13. The ceiling track system according to claim 12, wherein the screw is a metric screw.

* * * * *